US006632317B1

(12) United States Patent
Höfer

(10) Patent No.: US 6,632,317 B1
(45) Date of Patent: Oct. 14, 2003

(54) BAR ASSEMBLY

(75) Inventor: Reinhard Höfer, Eislingen (DE)

(73) Assignee: Saxonia Umformtechnik GmbH, Goppingen (DE)

( * ) Notice: Subject to any disclaimer, the term of this patent is extended or adjusted under 35 U.S.C. 154(b) by 0 days.

(21) Appl. No.: 09/856,118

(22) PCT Filed: Nov. 24, 1999

(86) PCT No.: PCT/EP99/09088

§ 371 (c)(1),
(2), (4) Date: Jul. 25, 2001

(87) PCT Pub. No.: WO00/31329

PCT Pub. Date: Jun. 2, 2000

(30) Foreign Application Priority Data

Nov. 24, 1998 (DE) ..... 198 54 191

(51) Int. Cl.[7] ..... B32B 33/00
(52) U.S. Cl. ..... 156/293
(58) Field of Search ..... 156/293, 303.1; 66/203, 206, 207, 208, 87, 90, 109, 114, 116

(56) References Cited

U.S. PATENT DOCUMENTS 4,522,009 A * 6/1985 Fingerson ..... 52/667

FOREIGN PATENT DOCUMENTS

| | | | | |
|---|---|---|---|---|
| DE | 44 38061 C1 | 12/1995 | ..... | D04B/27/02 |
| DE | 196 12910 A1 | 10/1997 | ..... | F16B/13/02 |
| DE | 196 27442 A1 | 1/1998 | ..... | F16B/11/00 |
| DE | 197 53590 C1 | 5/1999 | ..... | D04B/23/00 |
| EP | 0227018 A1 | 12/1986 | ..... | D04B/27/24 |
| EP | 0427974 A1 | 10/1990 | ..... | D01G/19/28 |
| EP | 0806507 A2 | 4/1997 | ..... | D04B/27/24 |
| GB | 1400989 | 1/1974 | ..... | D01H/5/14 |
| JP | 58120820 | 7/1983 | ..... | D01G/19/10 |

* cited by examiner

*Primary Examiner*—Richard Crispino
*Assistant Examiner*—Sing P. Chan
(74) *Attorney, Agent, or Firm*—Head, Johnson & Kachigian

(57) ABSTRACT

The invention concerns a set comprising a plurality of mutually juxtaposed, generally flat, plate-shaped components which are fixedly connected together, and a process for the production thereof. Production is simple and inexpensive to implement and that means also that the entire set can be produced inexpensively and sufficiently accurately in terms of fit. A process according to the invention for connecting together in the longitudinal direction to form a set a plurality of components disposed at a spacing in mutually juxtaposed relationship, in particular needles, whose main planes are disposed transversely with respect to the longitudinal direction, is distinguished in that the individual components are positioned at the correct spacing relative to each other, and at least one bar is inserted in the longitudinal direction into at least one aligned orifice in the components, in particular needles, wherein the outside diameter of the bar is only slightly smaller than the orifice, and the set is glued in the region where the bar passes through the components.

33 Claims, 4 Drawing Sheets

BAR ASSEMBLY

CROSS-REFERENCE TO RELATED APPLICATION

This application claims priority to PCT Application No. PCT/EP99/09088 filed Nov. 24, 1999, which claims priority to German Patent Application No. 19854191.0 filed Nov. 24, 1998.

FIELD OF USE

The invention concerns a set comprising a plurality of mutually juxtaposed, generally flat, plate-shaped components which are fixedly connected together, and a process for the production thereof.

In industrial uses, it frequently happens that a large number of mutually juxtaposed, often very thin, plate-shaped components have to be handled in conjunction with each other, for example in the bed of a knitting machine or when dealing with knitting members. For that purpose, a plurality of such components are joined together to form a set or array, thereby considerably facilitating handling and in particular replacement thereof. That is an important aspect in particular when the components are wearing parts and accordingly replacement has to be effected relatively frequently. Production from the solid material, for example by means of milling, is often no longer possible or is not economical, in particular when dealing with thin components.

In that respect, there are hitherto known different possible ways of connecting together those components which mostly comprise metal, in particular a carbon-bearing hardenable steel.

In that respect, welding is a rather unusual procedure as the welding temperature required can give rise to distortion of the components and in particular also the welding operation can mean that the relative position of the components with respect to each other can very easily change.

Another option involves individually glueing the components together in succession, but that is also a time-consuming procedure having regard to a large number of components in each set.

It is further known for the components to be joined together to form a set by the components being cast into another material, for example at the free ends of the components. If the demands in regard to load-bearing capability are low, casting can be effected using plastic material, while when a higher load-bearing capability is required the components are cast into a metal alloy with a low melting point, for example a lead alloy, or nickel silver.

A disadvantage here is that the casting material drastically increases the weight of the set, in particular when the components are cast into metal. In that respect, the cast set is not infrequently ten times as heavy as the set without the casting material, precisely when the components are very thin and small items such as for example the needles of a knitting machine.

The disadvantage here is that the casting operation preferably has to be effected at the free ends of the components as a casting procedure in the central region thereof is very much more complicated and in addition it is necessary to take account in regard to the dimensions involved of shrinkage of the casting material upon cooling, which requires a great deal of experience. It is however precisely the free end regions of the components that frequently serve as operational surfaces and have to be freely accessible.

It is further known for the components to be threaded on to dowel or fitting pins by a procedure whereby mutually aligned bores are provided in the components, with the pins being passed through the bores. The desired spacing between the individual components can be achieved by respective interposed spacer sleeves.

A further disadvantage is that the dowel pins required must be produced with very tight dimensional tolerances and are correspondingly expensive. Furthermore, arranging spacer sleeves between the needles in the operation of threading the components on to the pins is a difficult and time-consuming procedure. In addition that situation involves the problem of cumulative error in regard to the spacer sleeves.

It is further known for the components to be threaded on to a fitting tube by a procedure whereby aligned bores are provided in the components, through which the tube is passed. The components are fixed on the tube by subsequently expanding the tube radially outwardly by means of an expanding taper member or by an expanding bar which is pushed through the tube.

The disadvantage here however is that the length of the tube is decreased overall by virtue of expansion thereof, in other words, the initial length of the set does not correspond to the final length thereof, and accordingly the spacings of the components relative to each other are also altered during expansion of the tube. Due to that cumulative error only sets of limited length can be produced.

A further disadvantage is that on the one hand a certain minimum wall thickness and, because of a minimum inside diameter of the tube for the expansion element, thus a certain minimum outside diameter of the tube, are required to afford a sufficiently strong and stable connection. The mechanical loading of the edge regions of the components which are to be threaded on to the tube, around the orifice thereof, also means that the width of the components in the region of the orifices cannot be less than a certain minimum value.

a) Technical Object

Therefore the object of the present invention is to provide a set and a process for the production thereof, wherein production is easy and inexpensive to carry into effect and thus also the entire set can be produced on the one hand inexpensively and on the other hand sufficiently accurately in terms of fit.

b) Attainment of the Object

That object is attained by the features of claims 1 and 24. Advantageous embodiments are set forth in the appendant claims.

The fact that a bar is inserted into the mutually aligned orifices in the components and the bar is then glued to the set of components in such a way that the individual components are fixedly carried on the bar affords marked advantages over the previous fixing methods.

In that respect, the bar used for being pushed through the components must be less accurate in terms of fit than a dowel or fitting pin as it is not the clearance between the outside diameter of the bar in the initial condition and the inside diameter of the orifice in the components that determines the subsequent clearance of motion of the components within the set, as when using a fitting pin.

On the contrary, in making the connection, the individual components only have to be arranged in the correct relative position with respect to each other, more specifically in the desired final position relative to each other. On the one hand, insertion of the bar is a simple procedure as there may be sufficient clearance, approximately between one and five hundredths of a millimeter, between the outside diameter of the bar and the inside diameter of the orifice. On the other hand, the connection to the components is first completed by virtue of glueing to the bar, and thus even minor positional or dimensional deviations in the orifices in the components are compensated thereby. That simplifies and reduces the cost of production of the individual components. In addition the bar itself, in respect of its outside diameter, is only required to satisfy demands which are markedly below the close tolerances of a snugly fitting pin.

For example the diameter of the bar in contrast will change relatively greatly with the size of the components and is at least 4 mm. A usual diameter for components which are of a height of between about 10 and 20 mm is 3 mm.

While the individual components mostly comprise a carbon-bearing, that is to say hardenable steel which however is unhardened when making the connection, such as C80 or C100, a chromium-nickel steel is generally used for the bar.

The fact that no mechanical forces worth mentioning are applied to the clamping components when the bars are being inserted into the mutually aligned orifices or when the set is being glued means that the individual components do not have to be supported in the region of the orifices therethrough, but it is sufficient to position the individual components and fix them in place relative to each other in the functional region thereof. That affords the advantage that even those components which admittedly maintain the required dimensional tolerances such as for example straightness and so forth in the functional region, but not in the region of the orifices, can nonetheless be used as curvature and so forth which occurs exclusively in the region of the orifices admittedly manifests itself there for example in the form of different spacings between the components, but it does not influence correct positioning of the functional parts of the components with respect to each other.

A further advantage is that the manner of connection to form a set of components in accordance with the invention does not give rise to a cumulative error and it is thus possible to achieve almost unlimited lengths of sets. The defined length and the axial positioning in respect of the needles in the glueing operation means that it is possible to avoid the previously necessary operation of subsequently operating on the ends of the components.

A third advantage is that it is possible to use bars of very small outside diameter, more specifically of outside diameters which are adequate exclusively for the required flexural stiffness of the bars, as there is no need for an internal space therein for an expansion element to be pushed therethrough.

As moreover no mechanical forces act on the components in the region of the orifices, the remaining width between the edge of the component and the orifice in the component can be very small and as a result the component can overall be of small width.

As generally the spacings between the individual components of the set must be very small, that is to say between 0.3 and 3 mm, it is important to use an application process for the adhesive, which ensures that the annular contact location or gap between the outside periphery of the bar and the outside surfaces of the components is wetted. Preferably in that respect that annular contact location is not only wetted over its entire periphery, but also the outside periphery of the bar will be wetted over the entire length of the spacing between the two components, and in particular the entire spacing between the two adjacent components should be filled with adhesive, around the bars, in order to achieve a connection which is as durable as possible, this naturally being the case at all the bars in a set. To achieve a component which is as flat as possible, there are generally two bars which are spaced in the longitudinal extent of the component.

For that purpose therefore the adhesive on being applied must either be of very low viscosity or it must be introduced at the adhesive location under a suitable pressure. Furthermore, a high surface tension on the part of the adhesive is a positive consideration in order to provide that as large an area as possible on both sides of the contact location is contacted by the adhesive, by virtue of the surface tension thereof. In particular, it is advantageous to use adhesives which can be applied in the form of a thick fluid or paste at a temperature of about 20° C. and which then become very fluid upon heating to between about 150° C. and 200° C. and which at the same time harden very quickly. In order further to promote the glueing effect, it is also a positive consideration if the adhesive can penetrate into the orifice in the component, between the component and the bar. That is possible in particular when suitable cavities for that purpose are provided between the outside diameter of the bar and the inside diameter of the orifice in the component, for example by virtue of the size and/or the contour of the cross-section of the bar not being the same as that of the orifice and being correspondingly smaller.

That can be specifically implemented for example by the bar being provided with grooves extending in the longitudinal direction of the bar at the outside periphery of the bar while the orifice is of a smooth contour, or conversely, the inside periphery of the orifice has radially outwardly directed recesses while the outside diameter of the bar is of a smooth contour, irrespective of whether the basic contour is round, quadrangular, elliptical or the like, with a round contour generally being preferred for reasons related to manufacture.

A further option is that, in addition to the adhesive join, a join involving force-locking engagement or positively locking engagement between the outside diameter of the bar and the inside diameter of the orifice in a component is implemented before the glueing operation. That is possible for example by virtue of the mutually aligned orifices being of a pear-shaped contour and the bar being pushed into the wide end of that contour and then displaced in a direction towards the narrow end, and then becoming jammed therein in force-locking relationship by virtue of the wedging action which occurs. In the case of two orifices and bars, that displacement can be effected towards each other, with suitable alignment of the orifices.

c) Embodiment

BRIEF DESCRIPTION OF THE DRAWINGS

An embodiment according to the invention is described in greater detail by way of example hereinafter with reference to the Figures in which.

The Figures show an embodiment by way of example in which the components are the needles 1*a*, 1*b*, 1*c* of a textile-processing machine, for example a knitting machine.

Figure 1:
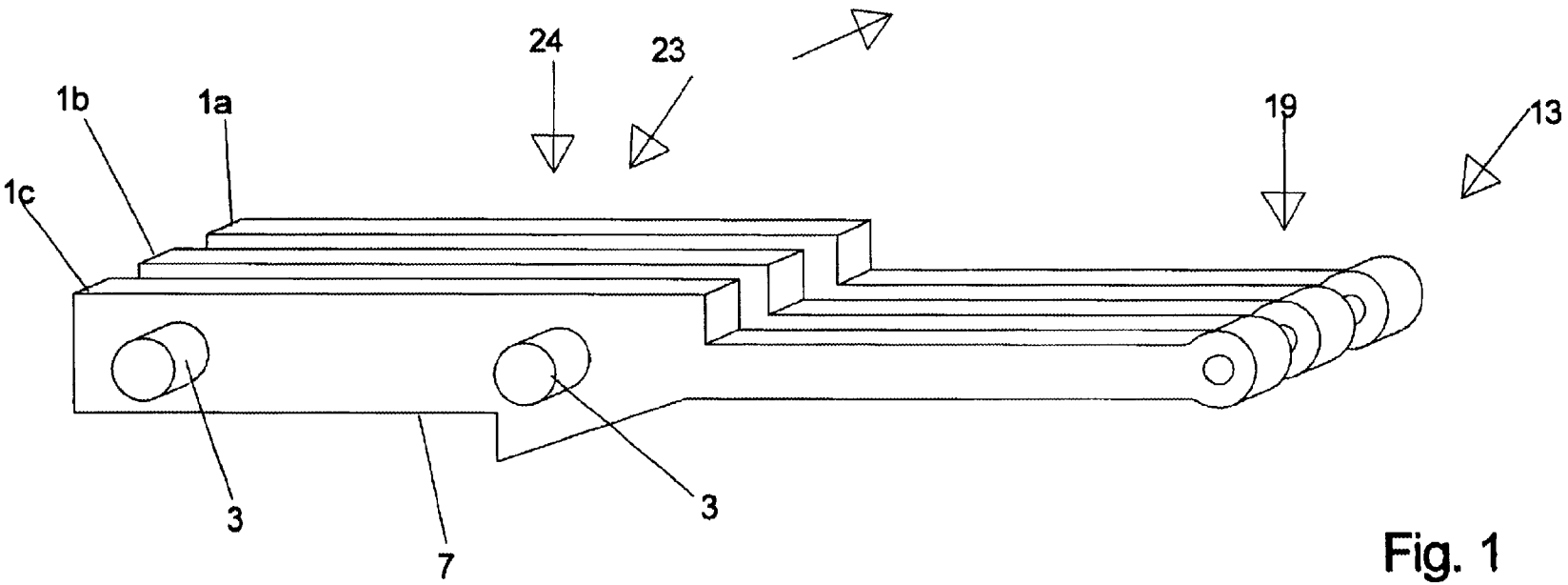
FIG. 1 shows a perspective view of a finished set.
Figure 4:
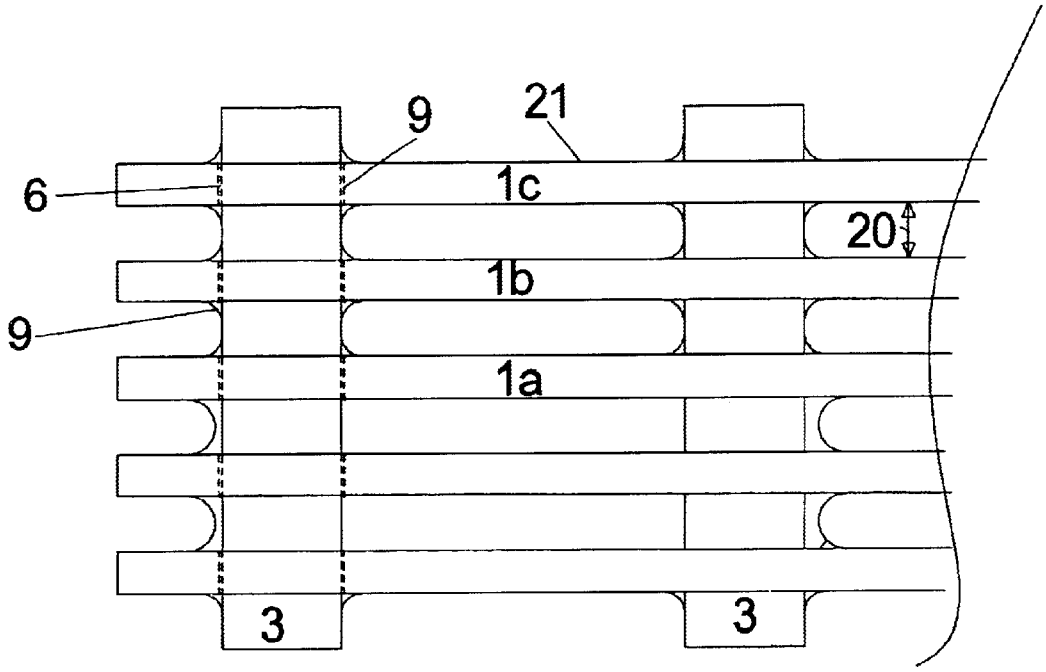
FIG. 4 shows a detail view of the finished set from above, that is to say on to the main plane of the set.

FIG. 1 shows the set 13 in its finished assembled condition, comprising a plurality of needles 1*a*, 1*b*, 1*c*, . . . which are arranged at a spacing in mutually juxtaposed relationship and the planes of which are disposed parallel relative to each other and which are aligned with each other. At the free end of the one half, the functional region 19, the elongate needles 1*a*, 1*b*, 1*c* have the aperture which is required for their subsequent function, while in the other half, the connecting region 23, they have two orifices 6 which are arranged in the longitudinal extent of the needle 1. A respective bar 3 is pushed through each of the orifices over all the needles 1, and glued to all the needles 1. This can best be seen from the detail view in FIG. 4.

This detail view shows how the adhesive extends arcuately from the outside surface 21 of the one needle over the peripheral surface of the bar 3 to the outside surface 21 of the oppositely disposed needle, defining a U-shaped outside contour, this affording a mechanically very strong and stable connection for the individual needles on the bars. It is only with a very low surface tension of the adhesive in comparison with the spacing 20 of the needles, that the adhesive of the one annular contact location does not reach the adhesive of the other annular contact location, as is shown at the right-hand half of FIG. 4.

In this respect, depending on the respective spacing of the two bars, as in the lower of the two spacings 20, the adhesive 9 may additionally fill the entire intermediate space between the bars 3, and this also contributes to stabilising the adhesive join.

As shown at the left-hand bar 3, in this case the adhesive 9 should preferably also penetrate into the orifice 6 of the respective component from the outside surfaces 21 between the bar 3 and the needle 1, more specifically preferably to such an extent that the entire free space between the bar 3 and the orifice 6 is filled with adhesive 9, and thus in the ideal situation this gives an integral, continuous block of hardened adhesive 9 for each finished set 13. As the penetration of the adhesive into the orifices 6 depends on the capillary action of the adhesive, that is to say the viscosity thereof in comparison with the size of the free space which is still present in the orifice, adhesives with a high viscosity are to be preferred.

Applying the adhesive is preferably effected when the set 13 is disposed in a horizontal position, in a downward direction of application as indicated at 24, so that the adhesive flows downwardly and around the bars under the effect of the force of gravity.

In that case, either the excess adhesive can drip off downwardly, or the rate at which the adhesive hardens is so matched that the adhesive admittedly moves downwardly as far as the lowest point of the periphery of the bars 3 and as far as the lower edge 7 of the needles 1, but has then already hardened to such an extent that it does not continue to move downwardly and drip off.

That can be achieved for example by the adhesive being applied in a warmed or heated condition and being greatly cooled down by the colder metal of the individual components in the course of the flow of the adhesive, whereby its flowability is reduced.

A further option provides that, when using an adhesive which hardens more slowly, the entire set is caused to rotate about an axis of rotation 25 as is shown for example in FIG. 2, for a defined period of time after application of the adhesive from above, that is to say in the direction of application 24. The axis of rotation 25 is parallel to the directions of the bars 3 and in the plane of the set, more specifically in such a direction that the direction of movement of the bars at the beginning of the rotary movement compensates for the movement of the adhesive, caused by the force of gravity, that is to say the bars 3 initially move downwardly in FIGS. 1 and 2.

Figure 2A:
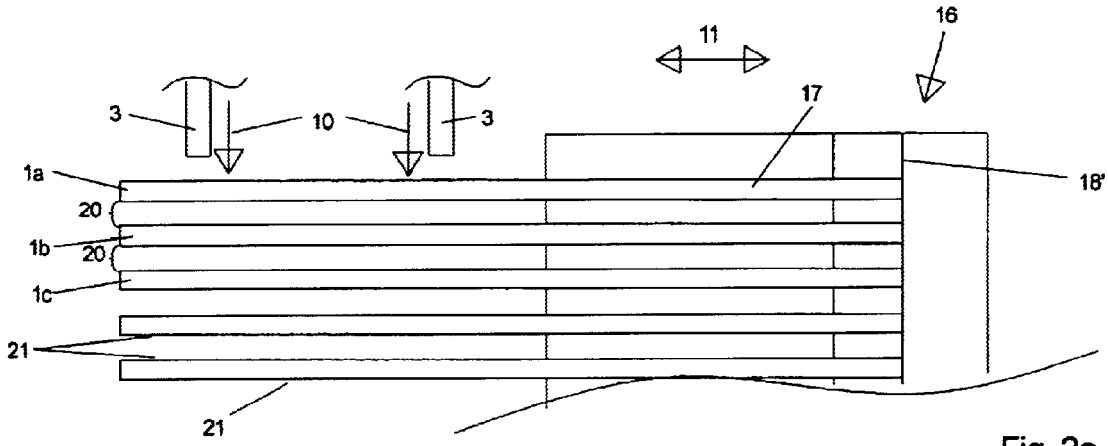
FIGS. 2 show the positioned needles before the set is assembled.
Figure 2B:
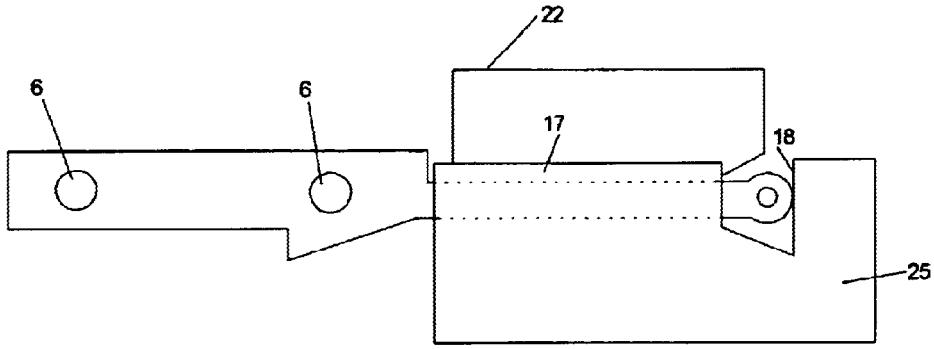

As it is essential for functioning of the set in the finished assembled and glued condition that the needles 1, in their functional region 19, in particular at their eyes, assume the correct position, that is to say in particular the correct spacing relative to each other, as shown in FIG. 2 the individual needles are already glued and in particular already fixed in a holding device 16 before insertion of the bars 3. The holding device 16 has upwardly open grooves 17 which are directed in mutually parallel relationship and the width of which corresponds to the thickness of the needles to be inserted therein, and an abutment 18 which extends in the longitudinal direction 10 and against which the individual needles are intended to bear and which thereby positions the needles correctly relative to each other in terms of their longitudinal extent. In regard to height, the needles are held in position by bearing against the bottom of the groove 17 against which they are applied for example by means of a holding-down device 22 which is applied from the open side of the respective groove, that is to say from above in FIG. 2*b*. The side view in FIG. 2*b* also shows that the entire connecting region 23 in which the orifices 6 for receiving the bars 3 are disposed is outside the holding device 16. Depending on the respective configuration of the functional region 19, for example with the illustrated thickened head of the needles 11 in FIGS. 2*a* and 2*b*, the head can project into a corresponding free space in the holding device under the needles so that the needles are caused to bear against the bottom of the grooves 17 only in the region between the eye in the functional region and the orifices in the connecting region.

As shown by the view of the needles 1*a*, 1*b*, 1*c*, . . . accommodated in the holding device 16 in FIG. 2, the bars are then preferably pushed from the same side or also from the opposite side through the mutually aligned orifices, and fixed in the final position prior to application of the adhesive, by means of a holding device (not shown).

Figure 3A:
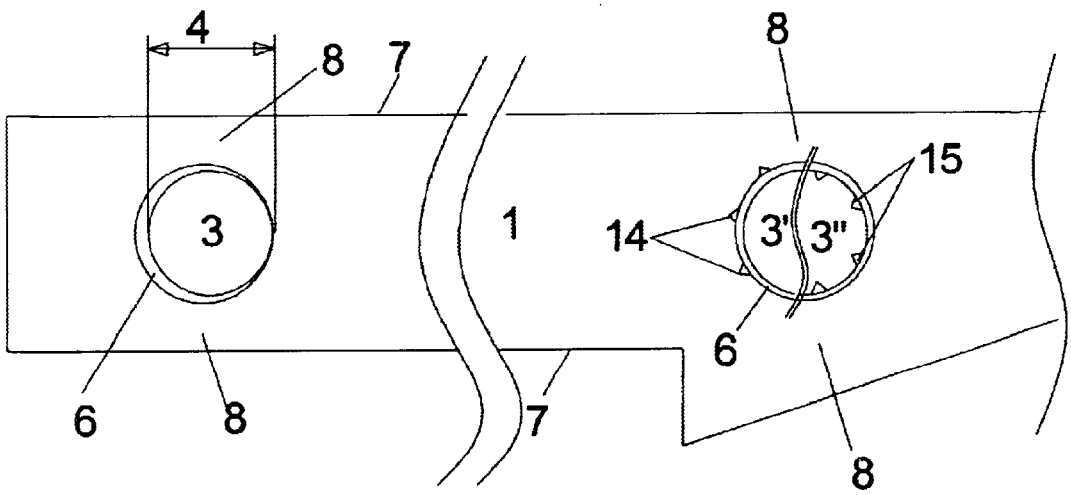
FIGS. 3 show detail views of the set prior to the glueing operation, considered in the longitudinal direction of the bars.
Figure 3B:
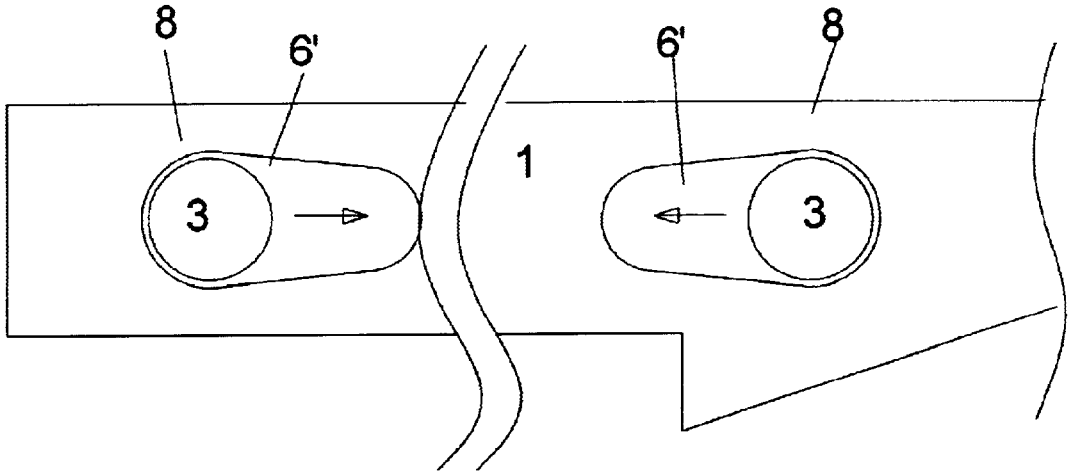

FIGS. 3*a* and 3*b* show detail views on an enlarged scale viewing in the same direction as FIG. 2*b*, but with the bars 3 already inserted but not yet glued in position. In that respect FIG. 3*a* shows that very small widths 8 between the edges 7 and the orifices 6 of the needles 1 are possible, by virtue of the lack of mechanical loading when making the connection to the bars, more specifically widths down to below 1 mm and even below 0.5 mm.

As can be seen in the left-hand orifice 6 in FIG. 3*a*, admittedly both the orifice 6 and also the bar 3 are of a round cross-section, but the diameter as indicated at 4 of the bar 3 is smaller. That results in a gap between the two, into which the adhesive can penetrate from the outside surfaces of the needle 1. The gap is generally eccentric if the bar 3 cannot be exactly centrally positioned in the orifice 6, which is generally not possible.

For, in manufacture of the individual needles 1 which are very thin and fine, not all needles are 100% flat and 100% straight. As however alignment of the needles is required in particular in the functional region 19, and is also achieved there by virtue of the holding device 16, the fact that needles are slightly curved can mean that the individual, mutually corresponding orifices 6 of the set are not 100% aligned with each other, and therefore the diameter of the orifices must be selected to be greater than that of the bars 3, by up to 10%, or up to 5% maximum, in order that the bar 3 can in any way still be pushed into the needles of the set, which are correctly positioned relative to each other in the functional region 19.

The right-hand view of the bar in FIG. 3*a* shows possible ways of still affording cavities for penetration of the adhesive between the inside periphery of the orifice and the outside periphery of the bar, even when the bar 3 and the orifices 6 are in a condition of good alignment and fit practically without clearance into each other. For that purpose, as in the left-hand case of the bar indicated at 3', there are recesses 14 which are directed radially outwardly from the orifice 6 and which pass through the needle 1 over the entire thickness thereof, but not in the region of the narrow remaining portion between the edge 7 and the orifice 6, that is to say the remaining width 8, in order not to additionally weaken same.

In contrast the bar 3' involves a smooth external contour. Both contours are of a round shape. The structure shown in the right-hand half of the bar as indicated at 3" is also a departure from the round basic shape. If in contrast the internal contour of the orifice 6 is a smooth contour, then the outwardly directed peripheral surface of the bar 3" has grooves or channels 15 which are continuous in the longitudinal direction thereof.

FIG. 3*b* shows a structure for connecting the bars 3 and the needles 1 together in force-locking relationship, prior to application of the adhesive, in addition to the glueing procedure. The force-locking connection is formed by the orifices 6 being of a conically decreasing, pear-shaped configuration, into which the bar 3 which is preferably of a round contour can be introduced only in the thick end of the pear-shaped orifice 6'.

Then, the bar 3 which has been introduced through all the needles is displaced transversely with respect to its longitudinal direction 10 towards the thinner end of the orifice 6', in which case it becomes wedged in the orifice 6'. Preferably, the two orifices 6' which are of the same configuration are arranged in the needles 1 with the thin ends facing towards each other so that displacement of the bars 3 in the orifices can be effected in mutually opposite relationship and at the same time. As in that situation mechanical forces act on the edge 8 of the needles 1, that is possible only when dealing with needles which can be of such a width that a sufficiently wide edge portion 8 remains.

LIST OF REFERENCES

| | |
|---|---|
| 1a, 1b, 1c | needles |
| 3 | bar |
| 4 | outside diameter |
| 6 | orifice |
| 7 | edge |
| 8 | width |
| 9 | adhesive |
| 10 | longitudinal direction |
| 11 | transverse direction |
| 13 | set |
| L | set length |
| LA | initial bar length |
| 14 | recesses |
| 15 | grooves or channels |
| 16 | holding device |
| 17 | grooves |
| 18 | abutment |
| 19, 19' | functional region |
| 20 | spacing |
| 21 | outside surface |

-continued

| | |
|---|---|
| 22 | holding-down means |
| 23 | connecting region |
| 24 | direction of application |
| 25 | axis of rotation |

What is claimed is:

1. A process for connecting a plurality of components disposed at spacings in mutually juxtaposed relationship together in a first direction to form a set, the components having main planes disposed transversely with respect to said first direction which forms a longitudinal direction of the set, including:

positioning the individual components at the correct spacing relative to each other;

inserting at least one metal bar in the longitudinal direction into at least one aligned orifice in the respective components, the bar being of an outside diameter only slightly smaller than the orifice; and glueing the set together in the region where the bar passes through the orifices through the components.

2. A process as set forth in claim 1 wherein the metal of said bar is selected from the group consisting of chromium-nickel steel, C-steel, and hardenable C-steel.

3. A process as set forth in claim 1 wherein the outside diameter of the bar is bigger than 0.5 mm.

4. A process as set forth in claim 1 wherein the components have a plurality of orifices.

5. A process as set forth in claim 1 wherein the orifice in the component has a 10% larger diameter than the outside diameter of the bar.

6. A process as set forth in claim 1 wherein the spacing between the individual components is between 0.4 mm and 3 mm.

7. A process as set forth in claim 1 wherein the adhesive is applied in the region of the spacing between the components to the outside surface of the bar over the entire length thereof in the spacing and also to the two adjoining regions of the outside surfaces of the two adjacent components.

8. A process as set forth in claim 1 wherein the adhesive is introduced into the orifice of the components between the bar and the component.

9. A process as set forth in claim 1 wherein the adhesive is applied in such an amount and in particular is of such a high surface tension that the spacing between the individual components is filled with adhesive around the entire periphery of its bar as far as the edges of the components.

10. A process as set forth in claim 1 wherein after at least partial hardening of the adhesive the adhesive which projects beyond the edges of the components is removed.

11. A process as set forth in claim 1 wherein the adhesive is a fast-setting adhesive and after application of the adhesive the set is rotated in particular for a defined period of time after application of the adhesive at such a speed about an axis of rotation which extends transversely with respect to the direction of application of the adhesive until the adhesive hardens.

12. A process as set forth in claim 11 wherein the adhesive hardens within a maximum of 240 seconds.

13. A process as set forth in claim 11 wherein the adhesive hardens within a maximum of 180 seconds.

14. A process as set forth in claim 11 wherein the adhesive hardens within a maximum of 100 seconds.

15. A process as set forth in claim 1 wherein the adhesive used is a two-component adhesive.

16. A process as set forth in claim 15 wherein the adhesive comprises a solvent-free hardener based on polyaminoamide and a solvent-free binder based on an epoxy resin.

17. A process as set forth in claim 15 wherein the adhesive is applied above the adhesive locations at ambient temperature and then heated to at least 100° C. and initially becomes very fluid due to the rise in temperature and moves downwardly at the adhesive location but at the same time in doing so hardens.

18. A process as set forth in claim 17 wherein the adhesive is heated to between 150° C. and 200° C.

19. A process as set forth in claim 1 wherein the adhesive is hardened while hot but application is effected in particular at ambient temperature.

20. A process as set forth in claim 19 wherein the adhesive is hardened at at least 150° C.

21. A process as set forth in claim 19 wherein the adhesive is a lacquer.

22. A process as set forth in claim 19 wherein the adhesive is applied by a dip process.

23. A process as set forth in claim 1 wherein the components are positioned relative to each other prior to the glueing operation by being accommodated in a holding device and wherein the orifices for bars are arranged outside the functional region.

24. A process as set forth in claim 23 wherein the holding device positions only the functional regions of the components relative to each other.

25. A process as set forth in claim 23 wherein in the glueing operation the bars are positioned in a radial direction so that lateral machining is unnecessary.

26. A process as set forth in claim 23 wherein the holding device has grooves extending in the transverse direction and an abutment extending in the longitudinal direction and transversely with respect to the transverse direction for the free end of the functional region of the components, the components being held in the grooves in the glueing operation.

27. A process for connecting a plurality of components disposed at spacings in mutually juxtaposed relationship together in a first direction to form a set, the components having main planes disposed transversely with respect to said first direction which forms a longitudinal direction of the set, including:

positioning the individual components at the correct spacing relative to each other;

inserting at least one bar in the longitudinal direction into at least one aligned orifice in the respective components, the bar being of an outside diameter only slightly smaller than the orifice wherein there are more than two orifices in each component and the orifices are not in one plane; and glueing the set together in the region where the bar passes through the orifices through the components.

28. A process for connecting a plurality of components disposed at spacings in mutually juxtaposed relationship together in a first direction to form a set, the components having main planes disposed transversely with respect to said first direction which forms a longitudinal direction of the set, including:

positioning the individual components at the correct spacing relative to each other, wherein the spacing between the individual components is between 0.1 and 5 mm and the adhesive is applied in a low-viscosity form;

inserting at least one bar in the longitudinal direction into at least one aligned orifice in the respective components, the bar being of an outside diameter only slightly smaller than the orifice; and glueing the set together in the region where the bar passes through the orifices through the components.

29. A process as set forth in claim 25 wherein the adhesive is of a viscosity of at most 370 dPas.

30. A process as set forth in claim 25 wherein the adhesive is of a viscosity of at most 340 dPas.

31. A process as set forth in claim 25 wherein the adhesive is of a viscosity of at most 300 dPas.

32. A process as set forth in claim 25 wherein the low-viscosity adhesive is applied to the set in a direction transversely with respect to the longitudinal direction and transversely with respect to the transverse direction.

33. A process as set forth in claim 32 wherein the adhesive runs from the top side to the underside of the set due to the force of gravity around the peripheral surface of the bar.

* * * * *